United States Patent [19]

Miller

[11] 4,203,493

[45] May 20, 1980

[54] RAILWAY BALLAST CLEANING APPARATUS

[75] Inventor: John R. Miller, Charlotte, N.C.

[73] Assignee: Southern Railway Company, Washington, D.C.

[21] Appl. No.: 962,697

[22] Filed: Nov. 21, 1978

[51] Int. Cl.[2] ..... E01B 27/00

[52] U.S. Cl. ..... 171/16

[58] Field of Search ..... 171/16; 104/2; 37/104

[56] References Cited

U.S. PATENT DOCUMENTS

| | | | |
|---|---|---|---|
| 865,261 | 9/1907 | Mehaffey | 171/16 |
| 1,591,790 | 7/1926 | Speno | 171/16 |
| 1,770,552 | 7/1930 | Robb | 171/16 |
| 2,273,528 | 2/1942 | Karp | 141/1 |
| 2,775,438 | 12/1956 | Bach et al. | 171/16 |
| 3,498,839 | 3/1970 | Mehta | 134/25 |

*Primary Examiner*—Jay N. Eskovitz

*Attorney, Agent, or Firm*—Watson, Cole, Grindle & Watson

[57] ABSTRACT

An apparatus for the cleaning of dirty railway ballast includes a dirty ballast remover and a ballast cleaner in the form of a hollow perforate drum rotatable about a central axis inclined upwardly from an inlet to an outlet end thereof. A spiral conveyor is mounted on the inner wall of the drum, and the inlet end thereof lies within a tank filled with a cleaning fluid, while the outlet end lies outwardly thereof. A spoils conveyor is disposed in the tank for the removal therefrom of spoils particles separated from the dirty ballast which is conveyed into the drum through its inlet end whereupon it is cleaned as it is tumbled by the spiral conveyor during drum rotation by separating the spoils particles from the dirty ballast which spoils particles move through the drum perforations. An unclogging device in the form of cylindrical rollers bear against the outer surface of the drum for unclogging any ballast particles from the perforations which may extend therethrough during drum rotation. And, a discharge hopper assembly is provided in the form of a pair of transversely spaced hoppers for discharging the clean ballast back onto the track. The hoppers are mounted for up-and-down movement about a central axis, and a deflector plate is coupled with one of the hoppers for movement away therefrom upon downward movement of the one hopper and for movement towards such hopper upon its upward movement, such movements depending on the relative load of clean ballast within the hoppers.

20 Claims, 10 Drawing Figures

RAILWAY BALLAST CLEANING APPARATUS

BACKGROUND OF THE INVENTION

This invention relates generally to a railway ballast cleaning apparatus, and more particularly to such an apparatus which includes a rotatable cleaning drum for separating spoils particles from dirty ballast by a tumbling action into and out of a cleaning liquid. Also, a clean ballast discharge assembly for controlling side-to-side discharge of clean ballast is provided.

Railway ballast cleaning devices have in the past been designed as including either a shaker screen for sifting the spoils particles from the dirty ballast, or a rotary sieve or screen which, upon rotation, sifts the dirty ballast through the sieve orifices which then fall upon a conveyor belt for conveying the spoils to one side of the road bed. However, these prior art devices are known to generate a tremendous amount of dust and polluted air surroundings as the apparatus moves along the track. Besides, these devices are somewhat inefficient in that the spoils particles cannot be satisfactorily removed from the dirty ballast during the shaker screen or rotary sieve operations. Moreover, the discharge hopper assemblies of the prior art, which are made part of the ballast cleaning apparatus, are incapable of accurately controlling the discharge of clean ballast to one or both sides of the track under various conditions of a ballast cleaning operation.

SUMMARY OF THE INVENTION

It is therefore an object of the present invention to provide a railway ballast cleaning apparatus which includes an inclined drum rotatable partly within a tank filled with cleaning liquid thereby avoiding the dusty and dirty surrounding conditions created by the prior art ballast cleaning devices.

Another object of this invention is to provide a positive means within the drum for conveying the clean ballast outwardly of its outlet end.

A further object of this invention is to provide a clean ballast discharge assembly which includes a pair of discharge hoppers mounted for seesaw movement in a transverse direction, and including a deflector plate coupled with one of the hoppers for movement of the plate toward that hopper requiring more clean ballast as compared to the other hopper.

In accordance with the invention, a perforate cleaning drum is inclined upwardly from its inlet to its outlet end and is mounted for rotation partially within a tank containing cleaning liquid such as water. A spiral conveyor is mounted on the inner surface of the drum between the inlet and outlet ends so as to cause the dirty ballast to be tumbled into and out of the cleaning liquid whereupon the spoils particles fall through the perforations and into the tank for removal by a spoils conveyor located in the tank. A cylindrical roller bears against the outer periphery of the drum for unclogging any clean ballast particles which may extend therethrough, and such clean ballast is conveyed by the spiral conveyor outwardly of the drum's outlet end and toward a clean ballast discharge assembly. Such an assembly includes a pair of spaced discharge hoppers mounted transversely of the rail car for up-and-down movement in a seesaw fashion. Such hopper movement is occasioned by the amount of clean ballast diverted thereinto as effected by a deflector plate which is coupled with one of the hoppers and which is made to move toward the other hopper upon downward movement of the one hopper, and vice versa upon upward movement thereof.

Other objects, advantages and novel features of the invention will become more apparent from the following detailed description of the invention when taken in conjunction with the accompanying drawings.

DETAILED DESCRIPTION OF THE INVENTION

Figure 1:
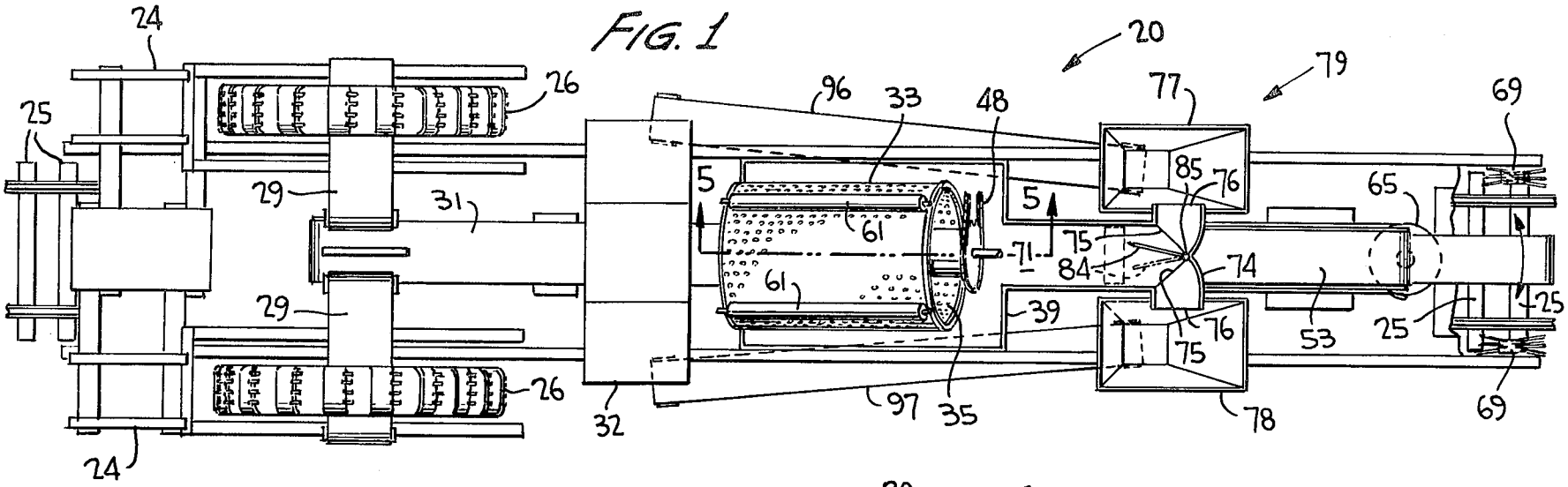
FIG. 1 is a top plan view of the apparatus according to the invention.
Figure 2:
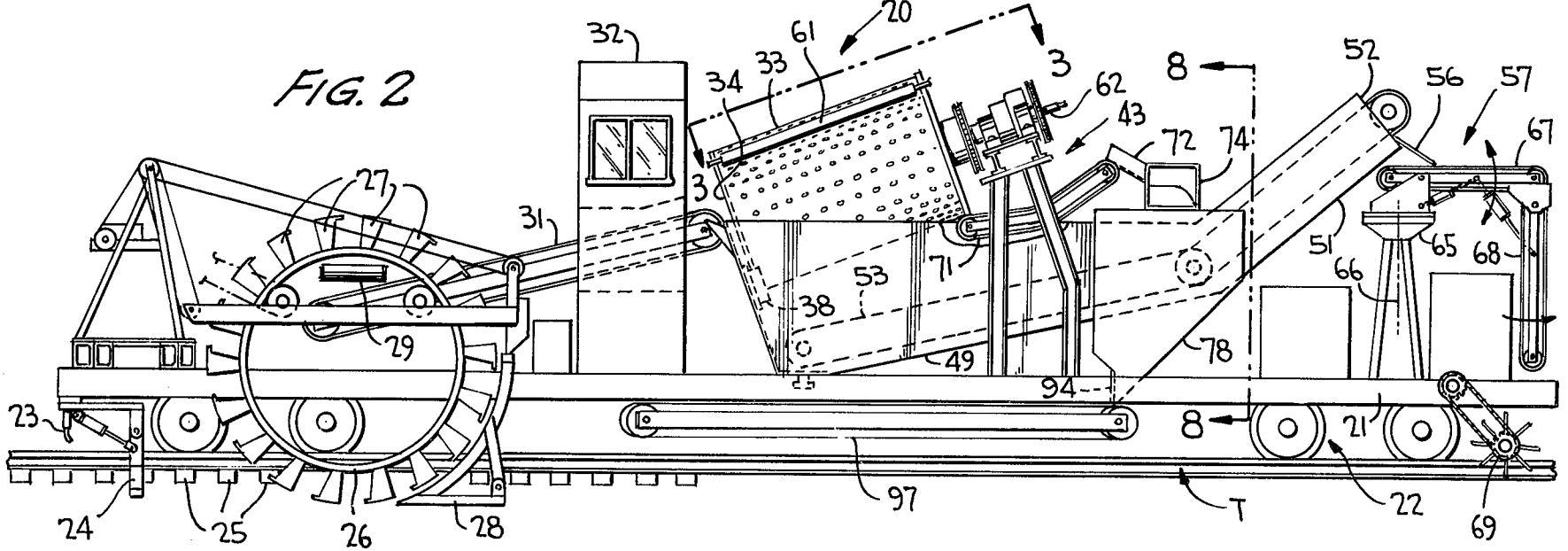
FIG. 2 is a side elevational view of the FIG. 1 apparatus.

Turning now to the drawings wherein like reference characters refer to like and corresponding parts throughout the several views, the railway ballast cleaning apparatus, generally designated 20, is shown in FIGS. 1 and 2 as mounted on the horizontal flat bed 21 of a rail car 22 disposed for travel along a railroad track T. Mounted at the forward end of the rail car, in the direction of the arrow of FIG. 2, are a pair of water spray nozzles 23 directed downwardly toward opposite sides of the track and being operator controlled for use if dust conditions merit during operation of the trencher wheels. Adjustable ballast plows 24 are mounted on the car just aft of the nozzles for pulling ballast from the ends of the railroad ties 25 so as to aid in the subsequent picking up of the ballast. These plows have adjustable breakaway features that trip a switch if they hit an object thereby giving off an alarm and applying the brakes of the rail car and/or train if desired. The shoulder ballast is picked up by means of trencher wheels 26 disposed along opposite sides of the track near opposite ends of the railroad ties as shown in FIG. 1. The trencher wheels are conventional and include a plurality of trencher buckets 27, although extra trencher buckets are provided for shallow trenching and to accommodate fast-forward travel. The trencher wheels are vertically adjustable for the digging of trenches (not shown) of the desired depth along opposite sides of the track as the shoulder ballast is thereby removed. Also, each trencher wheel has a crumbing shoe 28 for aiding in ballast pick-up, wheel height adjustment and serving as a back stop for any ballast returned by the buckets, thereby assuring a close return of such ballast to the pick-up area.

The trencher wheel buckets drop the ballast onto short lateral conveyors 29 which in turn discharge the dirty ballast into a hooded enclosure with rear curved ends (not shown) that deposit the dirty ballast onto an endless feed conveyor 31. This conveyor extends through an operator's control cabinet 32 in which the operator is stationed for controlling the various operations of the apparatus while in full view thereof.

Figure 6:
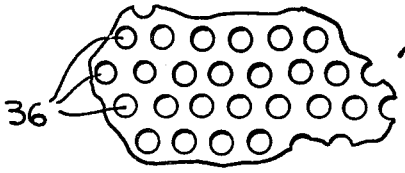
FIG. 6 is a detailed view showing the cleaning drum perforations.
Figure 5:
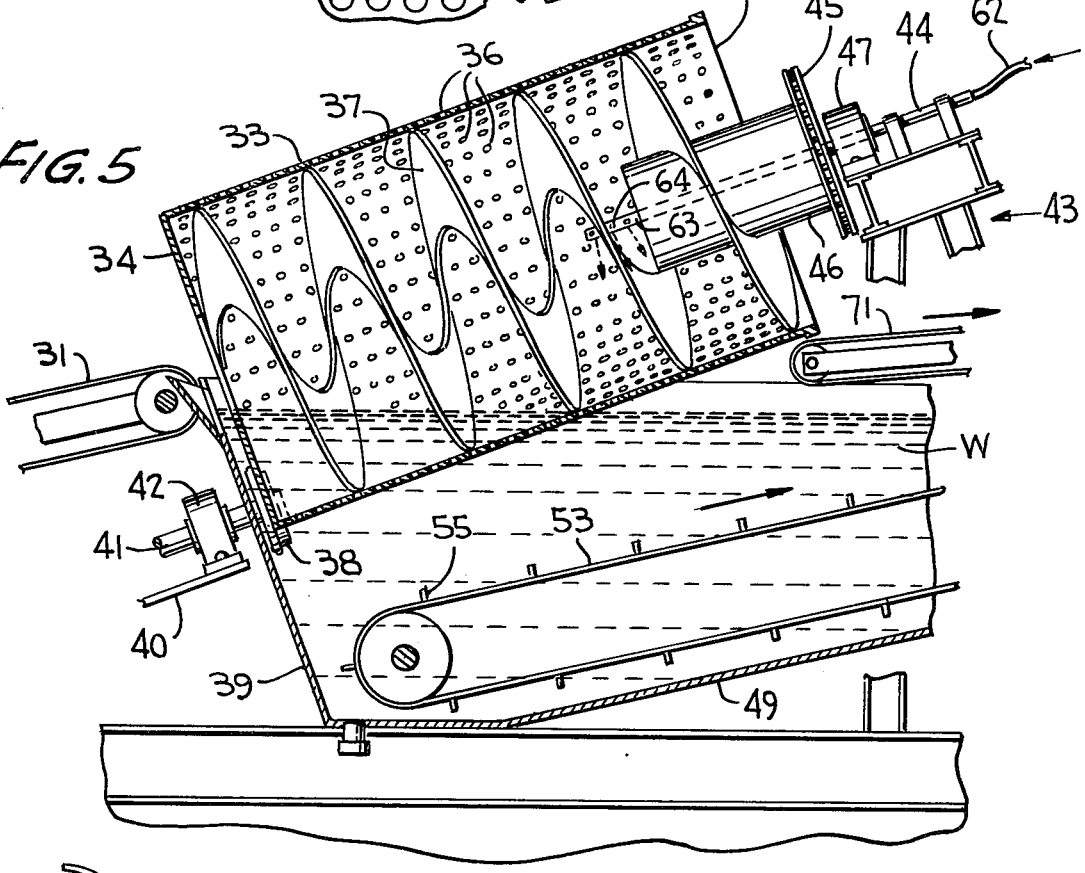
FIG. 5 is a sectional view of the cleaning drum and cleaning tank taken substantially along line 5—5 of FIG. 1.

The dirty ballast cleaning means according to the invention is in the form of an assembly which includes a cylindrical cleaning drum 33 open at its inlet and outlet ends 34 and 35, the drum being inclined upwardly from the horizontal from its inlet to its outlet end. The drum wall is perforated between opposite ends as defined by a plurality of through holes 36 (see FIG. 6) of a diameter permitting spoils particles of the dirty ballast to pass therethrough but preventing the clean ballast particles from falling outwardly thereof. As shown in FIG. 5, a spiral conveyor 37 is mounted on the inner surface of the drum between its opposite ends, the conveyor defining a central core opening along the drum axis.

Figure 4:
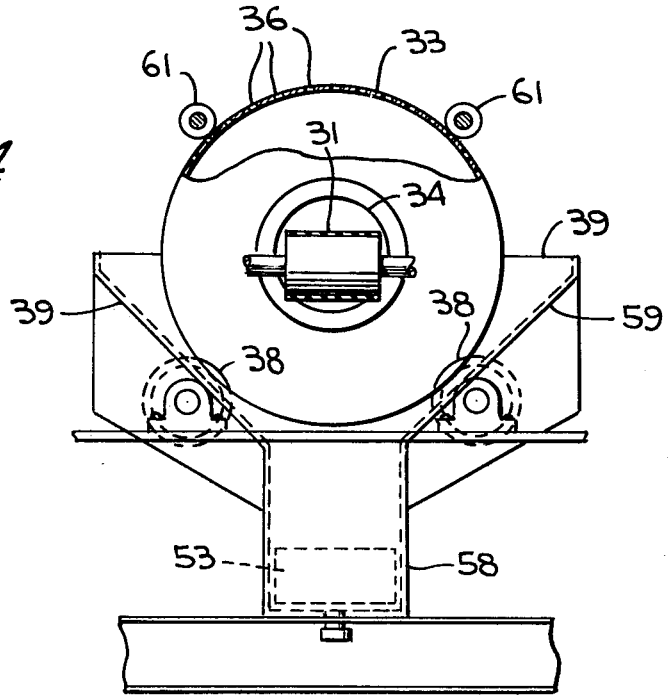
FIG. 4 is an end elevational view of the FIG. 3 assembly taken substantially along line 4—4 thereof.

The cleaning drum is supported at its inlet or forward end on a pair of spaced rollers 38 (as shown in FIG. 4), the rollers being submerged in a cleaning liquid (water W) contained within a cleaning tank 39. Rollers 38 are mounted on shafts 41 which extend outwardly of the tank are are supported within packed bearings 42 and 42*a*. The cleaning drum is thus partially submerged below the level of water W in the tank, and outlet end 35 of the drum is maintained completely out of the cleaning tank (shown in FIG. 5). The drum is supported in this upwardly inclined position by means of a structural support assembly 43 extending upwardly from bed 21 and having a shaft 44 mounted at the upper end thereof. A chain gear wheel 45 is mounted on the shaft, and is fixedly connected to a sleeve member 46 which is secured to one of the turns of the spiral conveyor. Shaft 44 rotates within a packed bearing 47 and, upon rotation thereof, the drum is caused to rotate abouts its central axis which extends through the shaft 44 axis. Drum rotation is effected by means of an endless chain 48 in engagement with gear wheel 45 as well as with a power gear via chain 48*a* from a conventional power source 50.

Ballast cleaning tank 39 is mounted on the flat bed of the railway car directly beneath the cleaning drum, and has a bottom wall 49 which inclines upwardly at a moderate slope from the forward end toward the rearward end of the tank, the bottom wall then inclining as at 51 at a greater degree of slope to the rearward open end 52 of the tank. Spoils conveyor means in the form of an endless conveyor 53 having a plurality of spaced flights 55 thereon is provided in the cleaning tank substantially parallel to sections 49 and 51 of the bottom wall thereof. The belt of this conveyor moves in the direction of the arrow shown in FIG. 5, and flights 55 function to move the fines or spoils particles falling through the drum perforations and into the bottom of the tank, these spoils particles being discharged outwardly of end 52 of the tank. A wiper 56 at the end of the spoils conveyor directs the spoils onto a spoils discharge conveyor generally designated 57.

Figure 3:
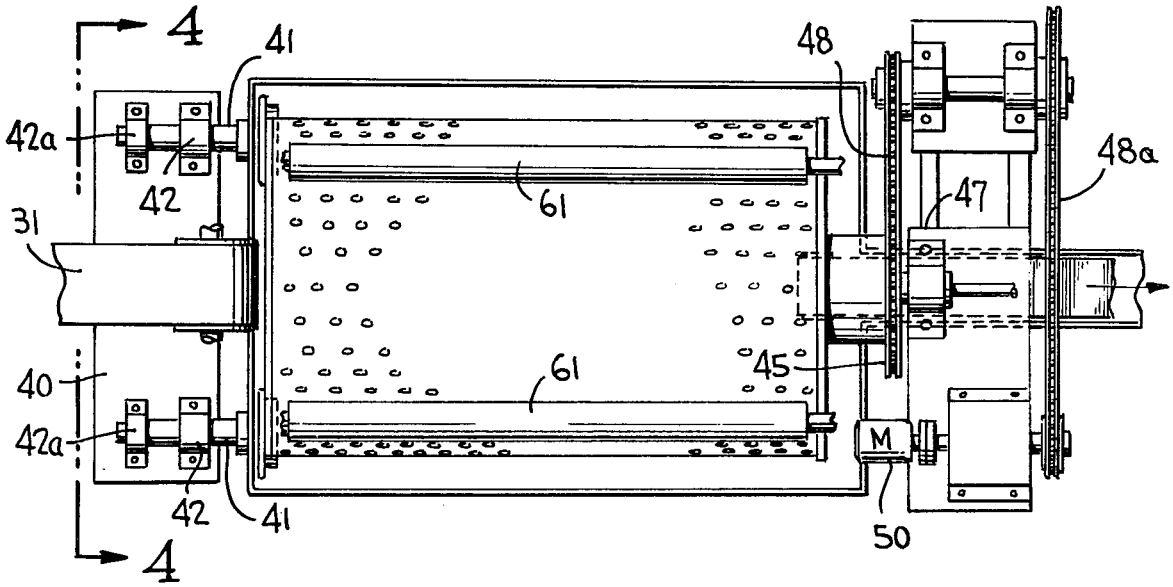
FIG. 3 is a top plan view, at a slightly enlarged scale, taken substantially along line 3—3 of FIG. 2, showing the details of the ballast cleaning assembly.

As seen more clearly in FIG. 4, tank 39 has a narrow throat section or trough 58 which underlies the cleaning drum, and conveyor 53 is disposed within section 58 for effectively scooping the spoils particles which fall thereinto and for conveying them for ultimate discharge from the tank. Also, it can be seen that the sidewalls of the tank downwardly converge as at 59 from the upper open end of the tank toward throat section 58. And, a pair of cylindrical idler rolls 61, having flat outer surfaces, are suitably mounted in place so as to bear against the outer cylindrical surface of cleaning drum 33, as shown in FIGS. 3 and 4. Rolls 61, which are mounted for rotation about their respective axes, are rotated by the drum during its rotation and function to unclog any of the larger clean ballast particles which may protrude into perforations 36 during the ballast cleaning operation. Thus, the drum perforations are maintained substantially unclogged so as to avoid any interference with movement of the fines or spoils particles through perforations 36.

During the ballast cleaning operation the tank water may need to be replenished from time-to-time. A water inlet hose 62 is therefore provided as shown in FIG. 5, the hose being connected to a water supply (not shown) and extending through shaft 44 which is made hollow for this purpose. A pipe 63 is connected to the hose and extends into the interior of drum 33 beyond the end of sleeve 46. The pipe has downwardly directed discharge openings 64 at its outer end for discharging make-up water into the tank by spraying the water on the ballast just before it is discharged outwardly through the outlet end of the drum. The ballast is therefore additionally cleaned by the make-up water while at the same time maintaining a predetermined water level in the tank. This water level may be automatically controlled by a float-operated servo-controlled valve (not shown) which will function to add water more proportionally as to the demand required thereby providing a more constant spray through pipe 63 for added ballast cleaning.

In operation of the apparatus thus far described, trencher wheel buckets 27 drop the dirty ballast onto short lateral conveyors 29 which discharge the dirty ballast into the hooded enclosure, with rear curved ends, which deposit the dirty ballast onto feed conveyor 31. This conveyor discharges into an approximately 30 inch diameter central opening at the forward or inlet end 34 of the cleaning drum. This inlet end is partially submerged below the level of the water in the tank, and the drum slopes upwardly from the horizontal toward its discharge end at approximately 20° with its outlet end being above the water level. During drum rotation, the spiral conveyor or flight 37 moves the ballast from the inlet to the outlet end of the drum and tumbles the dirty ballast in the process of such movement so as to cause the fines to be separated from the remainder of the ballast as the dirty ballast is effectively washed while being tumbled. The fines or spoils particles, typically of a size less than that of perforations 36 which are made approximately ⅜ inch in diameter, pass through these perforations unimpeded by any of the remaining larger ballast particles that may have a tendency to protrude outwardly through perforations 36 to thereby clog the drum perforations. Flat rollers 61 are provided for pushing back any ballast particles into the drum which may partially protrude through holes 36.

The fines or spoils particles passing through holes 36 settle toward the bottom of the cleaning tank having cross baffles (not shown) and a spoils conveyor 53 in bottom trough 58 thereof. This conveyor, having flights 55 which may be spaced approximately 12 inches apart, travels at a relatively slow speed and approximately parallel to bottom wall portions 49 and 51. Portion 49 is inclined upwardly from the horizontal approximately 12° until it reaches the water level, as shown in FIG. 2. Bottom wall portion 51 of the tank then inclines upwardly from the horizontal approximately 40° so as to reach an appropriate height at rearward end 52 of the tank and for assuring that the tank water is adequately drained back into the tank. Spoils conveyor 53 is designed with a bend at transition between bottom wall portions 49 and 51, and the spoils are discharged by a wiper 56 onto a two-stage accelerating, variable speed, belt conveyor system generally designated 57. This conveyor system is mounted on bed 21 by means of a structural support 65 for pivotal movement (indicated by the double arrow of FIG. 1) about vertical axis 66 between a position extending laterally to one side of the track and laterally to the other side of the track. This belt conveyor system includes an endless conveyor 67 capable of up-and-down movement in the direction of the double arrow of FIG. 2, and an endless conveyor 68 capable of outward pivotal movement in the direction of its arrow shown in this Figure. The spoils particles may therefore be discharged in different patterns onto the ground. Also, a special spoils railway car (not shown) may follow the FIG. 2 apparatus so that the spoils may be discharged into such car when they cannot be thrown to the side(s) of the track. And, tie brooms 69 are disposed for rotation outwardly of the track rails for sweeping the tops of ties 25 as apparatus 20 moves along the track.

The clean ballast, separated from the spoils particles during the aforedescribed ballast cleaning operation, are moved by spiral conveyor 37 outwardly of the outlet end 35 of the cleaning drum. Side baffling (not shown) will guide the clean ballast onto an inclined belt conveyor 71 which moves in the direction of the arrow of FIG. 5. This conveyor discharges the clean ballast into an enclosed chute 72 (FIG. 9), mounted on a support member 70, and having a discharge end 73 opening into a pair of lateral chute sections 74 having inlet ends 75 (FIG. 1) spaced approximately 90° apart. Outlet ends 76 (FIGS. 1 and 8) overlie hoppers 77 and 78 forming part of a clean ballast discharge assembly generally designated 79. The discharge assembly is mounted on flat bed 21 by means of vertical structural members 81 having transversely extending support beams 82 mounted at upper ends thereof as at 83 for pivotal movement (see FIGS. 7 and 8). Hoppers 77 and 78, which function as storage hoppers, are mounted to beams 82 at opposite ends thereof and outwardly of the pivotal 83 axis. The support beams in the hoppers are thus capable of moving about pivot 83 in a seesaw fashion, as generally designated by the curved double arrow of FIG. 8. The hoppers can therefore effectively seesaw up-and-down, although their travel speed is limited by hydraulic cylinders and flow controls (not shown).

Figure 9:
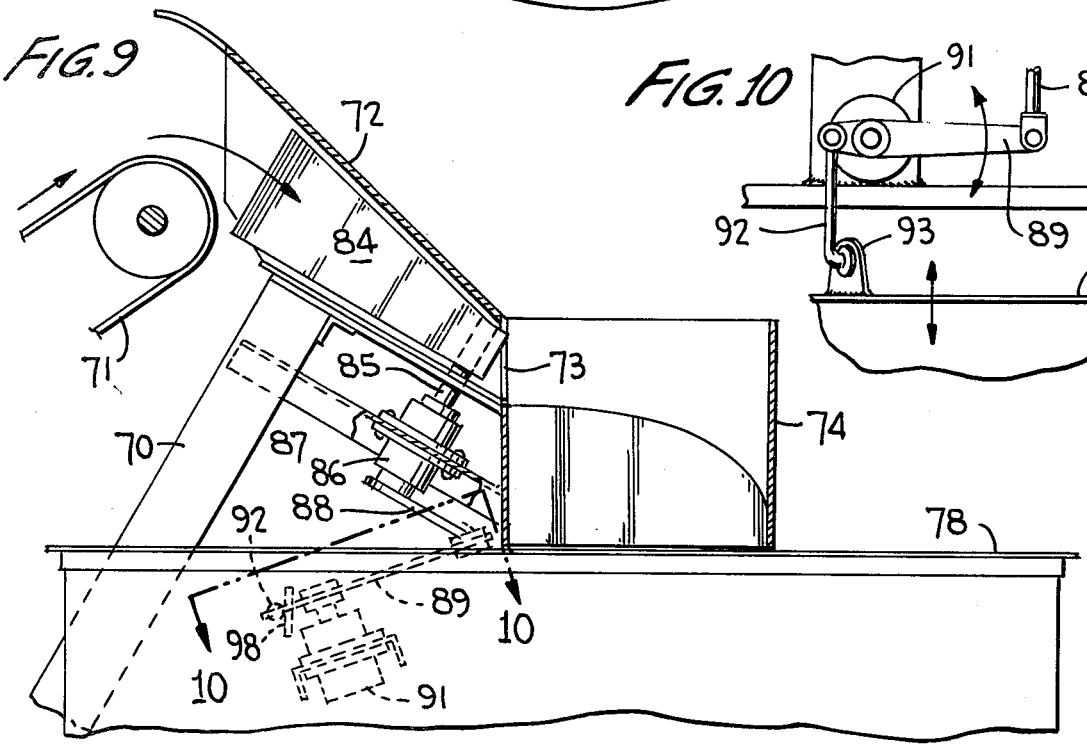
FIG. 9 is an enlarged vertical sectional view of the top portion of the discharge assembly of FIG. 7.
Figure 10:
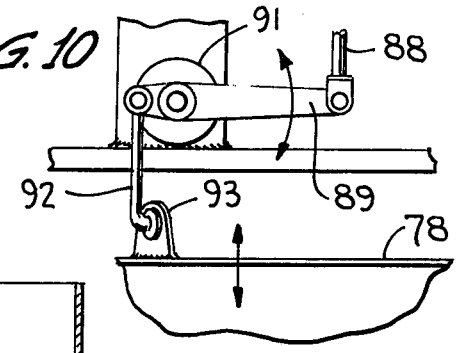
FIG. 10 is a detailed view of the link mechanism coupling the deflector plate of the discharge hopper assembly with one of the hoppers.
Figure 7:
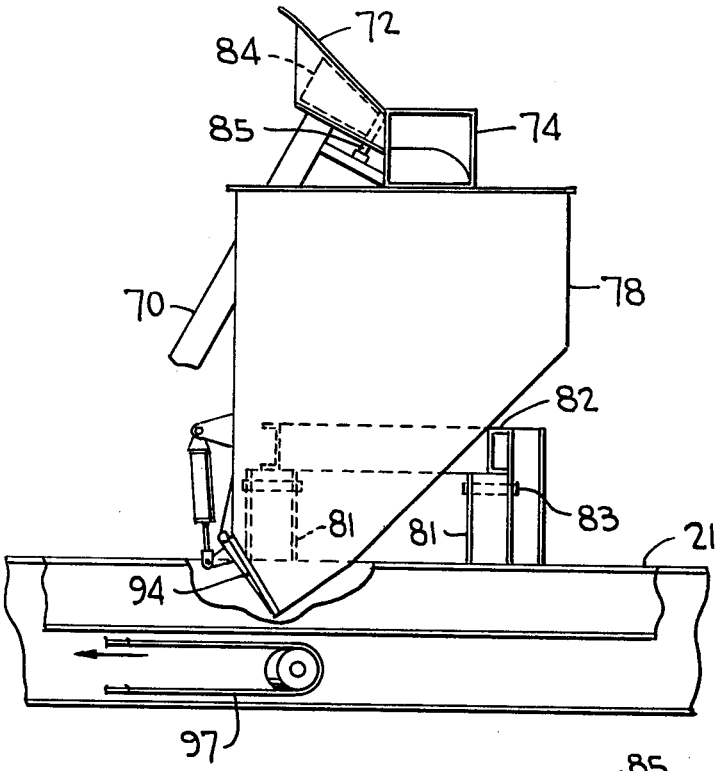
FIG. 7 is a side elevational view of the clean ballast discharge hopper assembly.
Figure 8:
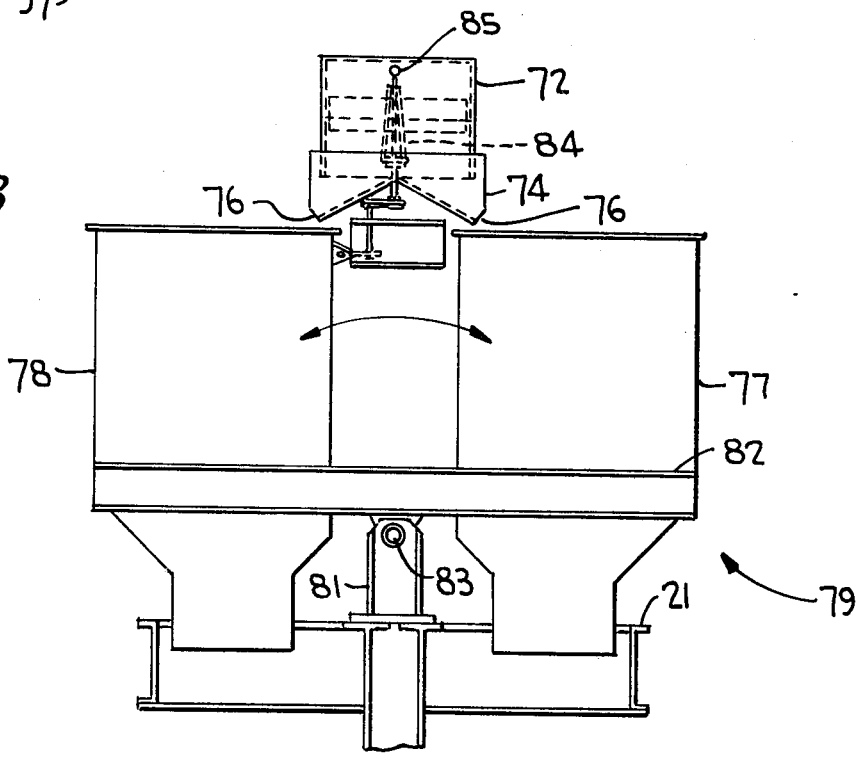
FIG. 8 is an end elevational view of the FIG. 7 assembly taken substantially along line 8—8 of FIG. 2.

Means for diverting clean ballast into one or the other of the hoppers or into both hoppers is provided in a form of a deflector plate 84 which lies substantially in a vertical plane within enclosed chute 72 (see FIGS. 7 and 9). The rearward end of this plate is mounted on a pivot rod 85, lying in the same vertical plane as plate 84 and extending through a packed bearing 86 mounted on a support piece 87. A link element 88 is fixedly connected at one end thereof to the lower end of rod 85 and is pivotally connected at its other end to another link member 89. This link member is supported between its ends on the shaft of a packed bearing 91 (FIGS. 9 and 10), the free end of link 89 being pivotally connected to another link member 92 which in turn is pivotally connected to an ear 93 fixedly mounted on hopper 78. This linkage arrangement is such that upon downward movement of hopper 78, deflector plate 84 is caused to pivot about the axis of rod 85 toward hopper 77 as shown in solid outline in FIG. 1. Conversely, upward movement of hopper 78 causes deflector plate 84 to pivotally move about the axis of its rod 85 toward hopper 78, as shown in phantom outline in FIG. 1. Both hoppers are substantially the same capacity, so that hopper 78 is caused to move downwardly upon being loaded with a quantity of clean ballast which exceeds that contained within hopper 77, and conversely with respect to the downward movement of hopper 77. Clean ballast is therefore automatically diverted into that hopper containing less ballast. Both hoppers are provided with doors 94 which are electrically operated by a control 95 by the operator for effectively controlling the amount of clean ballast to be discharged in either hopper. This discharged ballast will be conveyed onto endless conveyors 96 and 97 (see FIG. 1) having their rearward ends lying beneath the bottoms of the hoppers and diverging forwardly so that their forward ends lie just aft of shoes 28 and in the vicinity of the trenches dug at the track shoulders during the process of dirty ballast removal. These endless conveyors 96 and 97 travel in the direction of the arrow of FIG. 7 at a moderate speed. An adjustable smoothing ballast regulator (not shown) may be provided to form the ballast shape at the shoulder areas, and rotating brooms 69 having deflector shields function to clean excess ballast from the tops of the ties.

Storage hoppers 77 and 78 are utilized for storing cleaned ballast and for discharging the same onto conveyors 96 and 97 in approximately equal amounts for replenishing the shoulders with clean ballast equally when trenching wheels have removed dirty ballast in equal amounts along, for example, a straight track. Depending on the circumstances, however, one of the trencher wheels will be lowered relative to the other so as to remove a greater amount of dirty ballast from the shoulder thereby requiring replenishment of clean ballast to a greater extent from the associated storage hopper. The other hopper may thus be allowed to fill with its outlet door closed so that it will move downwardly and cause deflector plate 84 to be pivoted toward that hopper which needs more ballast. The hopper doors of both hoppers may then be regulated for discharging desired amounts of clean ballast onto conveyors 96 and 97 for replenishing the trenches with unequal amounts of clean ballast. Or, should only one of the trencher wheels be operated while moving along a curved track or while moving through a track junction, the hopper door of the other hopper will remain closed and, with that hopper filled with clean ballast, the other hopper in question will have clean ballast continuously fed into it so that with its door open only one side of the track will be replenished with clean ballast. Other variations in use are made possible for the presently designed discharge assembly.

The present apparatus may include a battery-powered emergency hydraulic package (not shown) in the event of engine power failure, and water may be furnished for the ballast cleaning operation by two water-hauling special railway cars (not shown) located behind the spoils car. One of these cars may have a telescopic broom crane, a hydraulic power unit, electrical and hose reels, and pumps with the capacity for pumping 18,000 and 36,000 gallons per hour of water at a 125-foot head. In the start-up operation of the present apparatus, the water storage capacity may be 50,000+ gallons. And, when water is added to the tank through hose 62 it may pass through a hydraulic oil core after the oil has reached a preset temperature. The exhaust pipes from the diesel engines powering the present apparatus may also pass through the water in the cleaning tank adding heat to the water for cold weather and reducing back pressure on the engine exhaust.

From the foregoing it can be seen that a ballast cleaning apparatus has been devised as having a ballast cleaner which not only avoids the dust and dirty atmosphere problems heretofore arising with the prior art shaker screen and dry tumbler cleaners, but assures that the fines or spoils particles will be efficiently separated from the dirty ballast and effectively removed, in an economical and relatively simple manner. Also, the invention provides for a simple and economical yet highly effective discharge assembly for the clean ballast wherein the shoulder trenches along the track are appropriately replenished with clean ballast in a practically automatic fashion with the need for fewer operators than before. A savings not only in time but manpower is therefore made possible with the present invention.

Obviously, many other modifications and variations of the present invention are made possible in the light of the above teachings. It is therefore to be understood that within the scope of the appended claims the invention may be practiced otherwise than as specifically described.

I claim:

1. In a railway ballast cleaning apparatus including, in combination, means mounted on a railroad car for removing dirty ballast from the vicinity of the track along which said car travels, ballast cleaning means mounted on said car, and means on said car for conveying the dirty ballast from said removing means to said ballast cleaning means, the improvement wherein said ballast cleaning means includes a drum having a perforate cylindrical wall open at opposite ends, a spiral conveyor mounted on an inner surface of said wall and extending between said opposite ends, an open tank mounted on a horizontal surface of said car and containing a quantity of cleaning liquid, said tank being disposed beneath said drum, said drum being mounted for rotation about an axis inclined relative to said horizontal surface, one of said drum ends constituting an inlet end lying at least partially within said tank below the level of cleaning liquid therein, the other of said drum ends constituting an outlet end lying wholly outwardly of said tank at a higher elevation relative to said inlet end, a spoils conveyor operatively disposed in said tank for the removal from said tank of spoils particles separated from the dirty ballast whereby the dirty ballast which includes the spoils particles may be deposited by said conveying means into said drum through said inlet end so as to be cleaned as it is tumbled by said spiral conveyor during drum rotation into and out of the cleaning liquid for cleaning the ballast by separating the spoils particles therefrom, said drum wall having perforations therein of such a predetermined size as to allow only the spoils particles to move through said perforations and into said tank for removal therefrom by said spoils conveyor, the cleaned ballast remaining in said drum being conveyed by said spiral conveyor outwardly of said drum through said outlet end.

2. In the apparatus according to claim 1, wherein said spoils conveyor comprises an endless chain having spaced flights thereon for conveying the spoils particles outwardly of said tank.

3. In the apparatus according to claim 2, wherein said tank has a bottom wall which inclines upwardly from a forward to a rearward end thereof, said spoils conveyor lying adjacent and parallel to said bottom wall.

4. In the apparatus according to claim 1, wherein means are provided in contact with the outer surface of said drum wall for unclogging any ballast particles from said perforations which may extend therethrough during drum rotation, said unclogging means thereby assuring free movement of the spoils particles through said perforations.

5. In the apparatus according to claim 4, wherein said unclogging means comprises at least one cylindrical roller bearing against an outer surface of said drum, said roller being mounted for rotation by said drum.

6. In a railway ballast cleaning apparatus including, in combination, means mounted on a railroad car for removing dirty ballast from the vicinity of the track along which said car is movable, ballast cleaning means mounted on said car, and means on said car for conveying the dirty ballast from said removing means to said ballast cleaning means, the improvement wherein said ballast cleaning means includes a drum comprising a cylindrical wall having perforations therein and being open at opposite ends, a spiral conveyor mounted on an inner surface of said wall and extending between said opposite ends, an open tank mounted on a horizontal surface of said car and containing a quantity of cleaning liquid, said tank being disposed beneath said drum, said drum being mounted for rotation about an axis inclined relative to said horizontal surface, one of said drum ends constituting an inlet end lying at least partially within said tank, the other of said ends constituting an outlet end lying wholly outwardly of said tank at a higher elevation relative to said inlet end, and means provided in contact with the outer surface of said drum wall for unclogging any ballast from said perforations which may extend therethrough during drum rotation, whereby dirty ballast which includes spoils particles may be deposited by said conveying means into said drum through said inlet end so as to be cleaned as it is tumbled by said spiral conveyor during drum rotation into and out of the cleaning liquid for cleaning the ballast by separating the spoils particles therefrom, said drum perforations being of such a predetermined size as to allow only the spoils particles to move through said perforations and into said tank, the cleaned ballast remaining in said drum being conveyed by said spiral conveyor outwardly of said drum through said outlet end.

7. In the apparatus according to claim 6, wherein a spoils conveyor is operatively disposed in said tank for the removal from said tank of spoils particles separated from the dirty ballast.

8. In the apparatus according to claim 7, wherein said spoils conveyor comprises an endless chain having spaced flights thereon for conveying the spoils particles outwardly of said tank.

9. In the apparatus according to claim 8, wherein said tank has a bottom wall which inclines upwardly from a forward to a rearward end thereof, said spoils conveyor lying adjacent and parallel to said bottom wall.

10. In the apparatus according to claim 1, further comprising discharge hopper means disposed adjacent said outlet end of said drum for the reception of the cleaned ballast and for discharging the cleaned ballast to the track from which the dirty ballast has been removed.

11. In the apparatus according to claim 10, wherein said hopper means includes a pair of transversely spaced-apart hoppers of identical capacity and first means for conveying the cleaned ballast from said outlet end into said hoppers, a transversely extending support beam mounted on the car for pivotal movement about an axis lying between opposite ends of said support, and said hoppers being mounted on said support beam outwardly of said axis for directing the cleaned ballast along the track.

12. In the apparatus according to claim 11, wherein said first means comprises an endless conveyor extending between said outlet end and said hoppers, and a diverter lying between said conveyor and said hoppers for diverting the clean ballast from said conveyor into one or the other or both of said hoppers, and said hoppers being capable of up-and-down movement about said axis.

13. In the apparatus according to claim 12, wherein said diverter comprises a vertically extending deflector plate mounted for pivotal movement at one end thereof, and link means connecting said one end of said plate with said one hopper for pivoting said deflector plate about said one end thereof in response to the up-and-down movement of said hoppers as caused by the amount of clean ballast diverted to said hoppers.

14. In the apparatus according to claim 13, wherein said diverter further comprises a pivot bar located at said one end of said plate, said plate being mounted on said bar for pivotal movement therewith, said link means comprising linkages interconnecting said bar and said one hopper for effecting pivotal movement of said plate about the axis of said bar away from said one hopper upon downward movement thereof and toward said one hopper upon upward movement thereof, whereby said one hopper is caused to move downwardly upon being loaded with a quantity of the clean ballast which exceeds the quantity of clean ballast contained within the other of said hoppers, and said other hopper is caused to move downwardly upon being loaded with a quantity of the clean ballast which exceeds the quantity of clean ballast contained within said one hopper.

15. In the apparatus according to claim 11, wherein said hopper means further includes second means for conveying the the cleaned ballast from said hoppers to the track from which the dirty ballast has been removed.

16. In the apparatus according to claim 15, wherein said hoppers have bottom discharge openings and means for closing same, and said second conveying means include endless conveyors disposed at one end thereof beneath said discharge openings, said conveyors extending toward said dirty ballast removing means on opposite sides of said car.

17. In a railway ballast cleaning apparatus including a rail car, means on said car for removing dirty ballast from the railway track along which said car travels, dirty ballast cleaning means on said car, and hopper means on said car for receiving clean ballast from said cleaning means and for discharging the clean ballast onto the track, said hopper means comprising a pair of hoppers of identical capacity spaced transversely of said car, a transversely extending support beam mounted on said car for pivotal movement about a longitudinal axis of said car lying in the direction of travel thereof, said hoppers being mounted on said beam outwardly of said longitudinal axis for discharging clean ballast toward opposite sides of said car, said hoppers being capable of up-and-down movement relative to each other depending on the relative loading of clean ballast therein, and said hopper means further comprising means including a deflector plate diverter disposed between said hoppers and capable of pivotal movement toward each of said hoppers for directing clean ballast into one or into the other of said hoppers or into both said hoppers, means interconnecting said diverter with said one hopper for causing said diverter to move away from said one hopper upon downward movement thereof and for causing said diverter to move toward said one hopper upon upward movement thereof, whereby the clean ballast is directed by said diverter into either or both said hoppers depending on the relative amount of clean ballast therein.

18. In the apparatus according to claim 17, wherein said deflector plate lies in a vertical plane, a pivot rod connected to one end of said plate, said interconnecting means comprising linkages coupled said one hopper to said pivot rod.

19. In the apparatus according to claim 18, wherein said hoppers have independently controlled bottom doors for regulating flow of clean ballast from said hoppers, and conveyor means adjacent said hoppers for conveying the clean ballast in a forward direction of car travel back to the track.

20. In the apparatus according to claim 18, wherein said diverter means further includes transverse chutes extending between said plate and said hoppers, said deflector plate having a forward end pivotable about said one end thereof.

* * * * *